US008276212B2

(12) United States Patent
Quintanilla

(10) Patent No.: US 8,276,212 B2
(45) Date of Patent: Oct. 2, 2012

(54) APRON, TOWEL AND BATH WRAP FOR INFANTS AND TODDLERS

(75) Inventor: Ana Paula Quintanilla, San Francisco, CA (US)

(73) Assignee: Maamam, llc, San Francisco, CA (US)

( * ) Notice: Subject to any disclaimer, the term of this patent is extended or adjusted under 35 U.S.C. 154(b) by 216 days.

(21) Appl. No.: 12/803,591

(22) Filed: Jun. 30, 2010

(65) Prior Publication Data

US 2011/0035857 A1 Feb. 17, 2011

Related U.S. Application Data

(60) Provisional application No. 61/274,253, filed on Aug. 14, 2009.

(51) Int. Cl.
*A41D 13/04* (2006.01)

(52) U.S. Cl. ..... 2/48

(58) Field of Classification Search ..... 2/48, 46, 2/49.1–49.4, 50–52, 84, 88, 104, 69, 69.5, 2/111, 207, 75; D2/860–864
See application file for complete search history.

(56) References Cited

U.S. PATENT DOCUMENTS 1,003,489 A * 9/1911 Moritz ..... 2/50
1,701,929 A * 2/1929 Mettam ..... 2/83
2,024,044 A * 12/1935 Johnson ..... 2/88
2,706,817 A * 4/1955 Schneider ..... 2/84
3,034,132 A * 5/1962 Landsberger et al. ..... 2/69.5
D275,827 S * 10/1984 Henry ..... D6/608
D343,498 S * 1/1994 Donahue ..... D2/864
5,611,095 A * 3/1997 Schneider ..... 5/482
D428,683 S * 8/2000 Davis ..... D2/719
6,536,047 B1 * 3/2003 Mullaly ..... 2/48
7,634,818 B1 * 12/2009 Trujillo et al. ..... 2/48
D622,483 S * 8/2010 Stein ..... D2/826
2006/0143769 A1 * 7/2006 Pathak et al. ..... 2/48
2010/0017929 A1 * 1/2010 Kenney ..... 2/49.1
2010/0083418 A1 * 4/2010 Moore et al. ..... 2/69.5

* cited by examiner

*Primary Examiner* — Amy Vanatta

(57) ABSTRACT

An apron, towel and bath wrap drying garment to help a caregiver bathing an infant or toddler stay dry and keep the infant or toddler warm immediately after the bath. As an apron for the caregiver, the present drying garment closes behind the neck and waist of the caregiver (with secure Velcro fasteners and optional elastic adjustable attachment for the waist) and can be easily removed. Two slits are appropriately present in the garment allowing the caregiver to slide the caregiver's arms through them when taking the infant out of the water, allowing the safe removal of the infant from the water with both hands, while preventing the caregiver from getting wet. These slits also become placeholders for the toddler's arms when the garment is folded into a bathrobe. A method is provided to wrap infants and form a bathrobe for toddlers to keep them warm until changed.

7 Claims, 5 Drawing Sheets

Fig. 8A
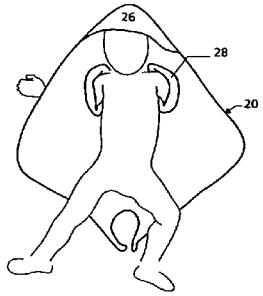
Fig. 8B
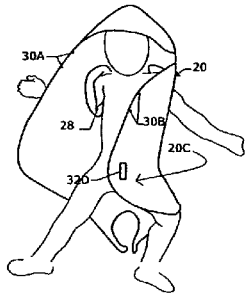
Fig. 8C
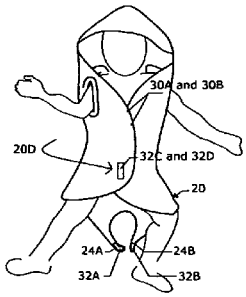
Fig. 8D'
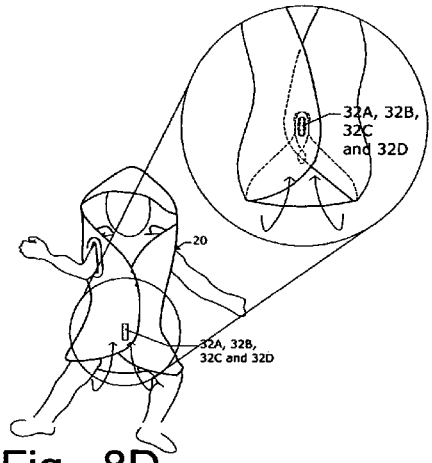
Fig. 8D

APRON, TOWEL AND BATH WRAP FOR INFANTS AND TODDLERS

I claim the benefit of the filing date of Provisional Patent No. 61/274,253 filed on Aug. 14, 2009.

BACKGROUND

1. Field

This garment relates to a combination of apron, towel and wrap to be used by a caregiver in the process of bathing and drying an infant or a toddler. Immediately after the bath, this garment can be used as a wrap for infants and a bathrobe for toddlers to keep them warm until the caregiver is able to change them.

2. Prior Art

Bathing and drying an infant or a toddler is usually a difficult, wet, and sometimes dangerous process. When dealing with newborns and small babies, the challenge for the caregiver is to coordinate lifting the infant from the tub and placing a towel around the infant. It is key for the caregiver to give the, infant full attention during the bath, and not be distracted by getting wet, or by trying to reach a towel. Removing an infant from a tub without a conveniently placed towel gets the caregiver wet and leaves the infant cold until the caregiver is able to wrap the towel around the infant. Furthermore, if one hand is required to hold a towel, then only one hand remains to lift and hold the infant. Considering the wet and therefore slippery conditions of the infant, the caregiver could drop the infant. Moreover, holding the towel under the chin or between the teeth to free up hands before lifting the infant from the tub is a very unpractical and inefficient procedure.

In the case of bathing a toddler who can stand and walk, the challenge shifts to keeping the toddler still in the bath. Toddlers typically splash around more than infants and are likely to get caregivers wet. Plus, they could simply get out of the bathtub and walk away wet before the caregiver can keep a towel around them. This can become dangerous since they would be dripping water everywhere, making the floor slippery. And even if the caregiver manages to put a conventional towel around the child, the chances that the towel will fall to the ground while the child is walking are high.

Thereafter, several types of bath towels have been proposed in the prior art. Although these applications may be suitable for the specific individual purposes to which they address, they are not suitable to solve the full extent of the above stated problems.

U.S. Pat. No. 5,321,863 to Yamaguchi, et al., (1994) is a bath towel for babies. It does not attach to the caregiver with easily operable fasteners and therefore does not provide an effective way to keep the caregiver dry during the bath. It is just intended to keep the infant dry after the bath and it doesn't have a hood.

U.S. Pat. No. 4,685,154 to Smith (1987) is an apron and infant towel. It does not cover the caregiver to the neck allowing that exposed area to get wet. It is comprised of two big terry cloth panels (for the front and rear of the caregiver) making its manipulation unpractical and cumbersome. It does not provide an effective way to wrap the infant or toddler and stay on (in case the child moves). Moreover, it doesn't have a hood.

U.S. Pat. No. 6,594,829 to Turkheimer (2003) is a protective towel wrap. This towel is composed of three separate pieces making it unpractical to use. Furthermore, Turkheimer's towel does not provide a practical wrap that fastens like a bathrobe for toddlers without having part of the towel hang or come loose, especially when they walk around.

U.S. Pat. NO. 3,629,865 to Weiner (1971) is a baby towel and U.S. Pat. No. D343,498 to Donahue (1992) is a combined apron bib for a user and bath towel for an infant. When used by the caregiver, these towels fasten around the neck of the caregiver but not around the waist. This might leave the caregiver unprotected and the towel hanging when the caregiver is bathing the child with the, risk of the bottom part of the towel getting soaked if it incidentally dips in the bath water. Neither of these towels provide for toddlers, a practical wrap that fastens around them like a bathrobe, without having part of the towel hang or come loose, especially when they walk around. Furthermore, Weiner's towel doesn't have a hood to insure warmth for the head of the infant or toddler.

U.S. Pat. No. 6,536,047 B1 to Mullaly (2003) is an infant holding garment. It is big and cumbersome. It uses a significant amount of drying fabric, which could be uncomfortable for the caregiver. It's not easily removable since it has a belt that has to be manually tied with a knot: it can be very difficult to untie the knot when holding the infant. It does not provide a practical wrap for infants or toddlers.

None of the above inventions have two slits appropriately located through which the caregiver can slide his/her arms to tend to infant. This functionality is particularly useful when the caregiver lifts the infant with the caregiver's arms through these slits. The towel part that is over the caregiver's chest forms a convenient sling-like shape, which provides both safety and comfort for infant and caregiver. Moreover, this functionality provides even more protection to the caregiver from getting wet, and helps prevent water dripping on the floor making it more slippery for the caregiver. Finally, these slits are particularly useful when the garment converts into a bathrobe: they become the placeholders for the child's arms.

SUMMARY

As such, it may be appreciated that there is a continuing need for a new and improved drying garment modified to be worn and used by the caregiver during the bath to avoid getting wet and safely pick up the infant/toddler from the water. Immediately after the bath, this garment can be used to keep the child warm until the caregiver can dress him or her. For infants, the drying garment can be folded and fastened around them like a wrap. For toddlers, the garment can be fastened around them to become a robe type garment that is neither too bulky nor heavy. Therefore, the child stays comfortably dry until changed.

In these respects, the present application significantly departs from the conventional art given its inventive combination of a few simple component elements arranged and configured as disclosed herein.

The present drying garment achieves its intended purposes through a new, useful, functional and safe combination of simple component elements and method of use. It is composed of a minimum number of functioning parts made of readily available, high quality materials, at a very reasonable cost to manufacture.

The present drying garment consists of one main panel made of absorbent material that is open at one end to form a collar that can easily but securely attach around the caregiver's neck by Velcro tabs or similar type fasteners as taught by Mestral, U.S. Pat. No. 3,009,235, dated Nov. 21, 1961. These fasteners are sufficiently long to permit variations in collar circumference for flexible use. A similar Velcro connection allows the caregiver to close the garment around the waist with an optional adjustable elastic attachment, allowing a more comfortable and secure wear of the towel as an apron. The Velcro fasteners allow the caregiver to easily detach the garment with one hand from around the waist and the neck.

The present drying garment has a built-in hood made of the same absorbent material as the main garment that can be used for infants and toddlers to dry their heads and keep them warm.

The present drying garment can be worn two ways depending on whether the caregiver is bathing an infant or a toddler. If bathing an infant, the caregiver wears the garment as an apron with the hood facing outward. If bathing a toddler, the caregiver wears the garment as an apron with the hood facing the caregiver's body. The positioning of the hood either facing outward or facing the caregiver's body, is an important first step for the use of the method here proposed for the drying garment in either infants or toddlers.

When the caregiver is ready to pick up the infant or the toddler from the water, the caregiver easily detaches the garment from around the waist.

The present drying garment has two slits appropriately located through which the caregiver can slide his/her arms to lift the infant from the water when ready. This provides additional protection to the caregiver's arms and clothes from getting wet. Moreover, lifting the infant with the caregiver's arms through the slits will form a sling-like shape with the towel part that is over the caregiver's chest where the infant can then be held comfortably, without the caregiver getting wet. Finally, this functionality helps prevent water dripping on the floor making the surface safer for the caregiver to walk on, and therefore reducing the clean-up workload as well.

In the case of bathing an infant, the caregiver wearing the apron with the hood facing outward can pick up the infant from the water and place him/her on the caregiver's chest. Then, the caregiver can remove his/her hands from the slits one at a time (while continuously holding the infant) and put the hood on the infant's head. From this point, the caregiver can place the infant on the changing table and detach the Velcro fasteners around the neck with one hand to release the collar. Finally, the present towel can be folded around the infant to nestle and snuggle the infant, without being too loose or too heavy, keeping him or her warm.

In the case of bathing a toddler, the caregiver wearing the apron appropriately, can make the child stand, then put the hood on the child's head and detach the Velcro fasteners around the caregiver's neck to release the collar. The toddler can then be picked up with the present garment wrapped around him or her. The caregiver can then continue drying the toddler and proceed to help the toddler wear the garment as a bathrobe by placing each arm in the respective slits present in the garment. Caregiver can then proceed by closing the conveniently located snap buttons and Velcro tabs in the front and finally, by folding the remaining bottom part of the garment between the child's legs. These steps transform the drying garment into a bathrobe that is comfortable for the child, and that does not have loose pieces dragging on the floor.

Finally, the shape and size of the present drying garment combined with the type of material used (light, soft, absorbent) make this garment compact and portable (while still achieving its intended purposes). This allows caregivers to easily take the garment to the pool, the beach or on any trip, as needed.

DRAWINGS—FIGURES

The drawings presented herewith illustrate the preferred mode presently contemplated by the inventor and clearly disclose the above advantages and features of the embodiment as well as others which will be readily understood from the detailed description there of.

In the drawings:

FIG. 1 shows a front view of a drying garment 20; apron, towel, and bath wrap for infants and toddlers made of drying fabric 20A with rounded corners in accordance with one embodiment of the invention.

FIGS. 2 and 2' show front and perspective enlarged views of an illustrative adjustable elastic attachment 34 in accordance with one further embodiment of the invention.

Figure 1:
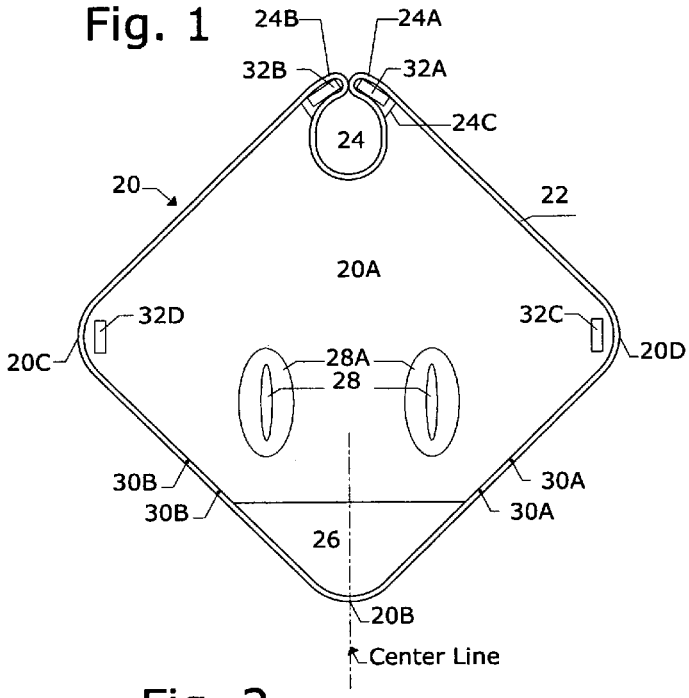
Figure 2:
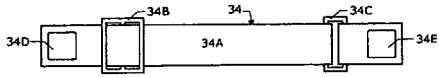
Figure 2:
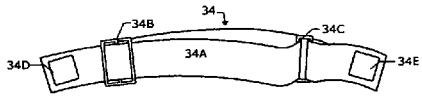
Figure 3:
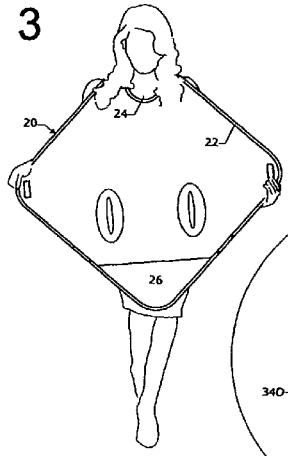
FIG. 3 shows a front pictorial illustration of a caregiver, wearing embodiment 20 as an apron with hood 26 facing outward as necessary to receive an infant.
Figure 3A:
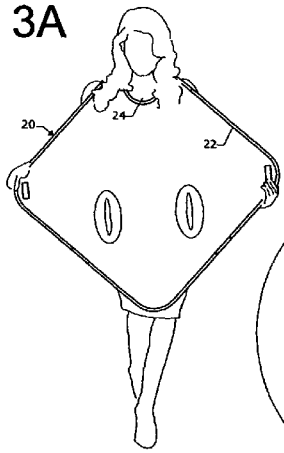
FIG. 3A shows a front pictorial illustration of a caregiver, wearing embodiment 20 as an apron with hood facing caregiver's body as necessary to tend to a toddler.

FIGS. 7A, 7B, 7C, and 7D show the steps to swaddle an infant with embodiment 20 once infant has been placed in a safe horizontal surface.

FIGS. 8A, 8B, 8C, and 8D' show the steps to use embodiment 20 as a bathrobe on a standing toddler.

DRAWINGS—REFERENCE NUMERALS

20 front drying panel
- 20A main drying portion
- 20B bottom
- 20C right wing
- 20D left wing

22 trim
24 neck circular opening
- 24A neck end leg
- 24B neck end leg
- 24C neck end leg reinforcement

26 hood
28 arm slits
- 28A arm slit reinforcement

30 snaps
- 30A snap stud
- 30B snap socket
- 30A snap stud
- 30B snap socket

32 Velcro tabs
- 32A Velcro hooks front and back of towel
- 32B Velcro loops front and back of towel
- 32C Velcro hooks only back of towel
- 32D Velcro loops front and back of towel

34 adjustable elastic attachment
- 34A elastic
- 34B fastener to adjust size
- 34C rectangular fastener
- 34D Velcro hooks on both sides of elastic
- 34E Velcro loops on both sides of elastic

DETAILED DESCRIPTION AND OPERATION

The employment of embodiment 20 as an apron as shown on FIGS. 3 through 5A encompasses placing the main drying portion 20A against caregiver's chest and securing circular opening 24 around caregiver's neck. This is accomplished by compressing Velcro tabs 32A and 32B with light to moderate pressure to make a secure connection and form the enclosed collar FIG. 4A'.

Velcro Tabs 32A and 32B which are attached to neck end legs 24A and 24B are sufficiently long to permit variations in collar circumference for flexible use. These Velcro tabs are also aligned to correspond with each other making a secure connection when so disposed. Installation in both sides of neck legs 24A and 24B, allows for fastening no matter which one is on top making it functional for right or left hand users.

A trim 12 made of cotton bias finishes the perimeter of embodiment 20 preventing the fabric to come undone as it provides design accent color.

Figure 4:
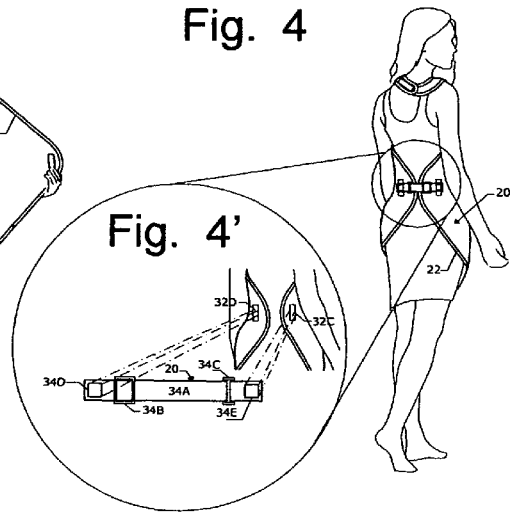
FIGS. 4 and 4A show a rear pictorial illustration of caregiver wearing embodiment 20 as an apron, wrapped around the waist and fastened with FIG. 4 or without FIG. 4A adjustable elastic attachment embodiment 34. 4' and 4A' are enlargements of the Velcro attachments.
Figure 4A:
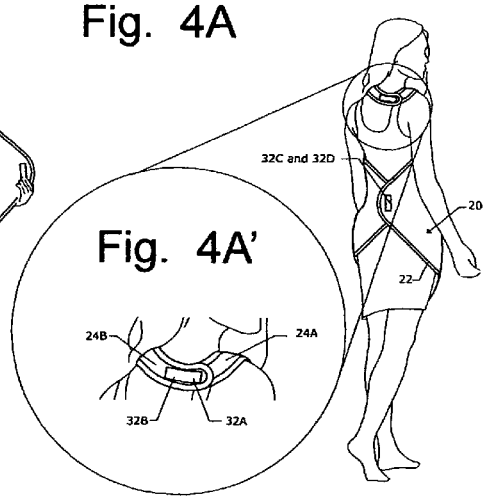
Figure 5:
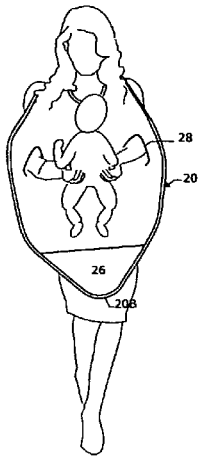
FIGS. 5 and 5A show caregiver wearing embodiment 20 when removing infant FIG. 5 or toddler FIG. 5A from the water.

Two Velcro tabs 32C and 32D allow caregiver to wrap embodiment 20 around his/her body as shown in FIG. 4A. When necessary, an adjustable elastic attachment 34 may be used as an extension FIG. 4. This provides comfort while moving around and prevents embodiment 20 from coming forward and getting wet while bending to help infant or toddler in a bathtub.

Figure 6:
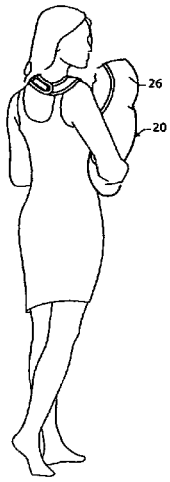
FIG. 6 shows caregiver carrying infant wearing embodiment 20 as a hooded towel and taking the baby to the correspondent area to be dried, swaddled or changed.

To secure adjustable elastic attachment to embodiment 20, caregiver must compress Velcro tab 34E to 32C and 34D to 32D with light to moderate pressure as shown in FIG. 6'. Embodiment 24 made from elastic 34A provides a wider range of extension and keeps embodiment 20 close to the body while it allows for mobility. Fasteners 34B and 34C allow length adjustment.

Once embodiment 20 is secured in place 4 or 4A about neck and fastened around the waist, caregiver is ready to tend to infant or toddler during bath time while being protected from getting wet.

From here on, the following steps are different depending on whether the caregiver is bathing an infant or a toddler.

Infant Case

Prior to removing infant from the water caregiver will let loose from waist embodiment 20 by releasing Velcro Tabs 34D and 34E with one hand to remove adjustable elastic attachment 24 completely. From here on caregiver will put arms one at a time through two slits 28 while other hand is holding the infant. Arm slits are located approximately 12" from bottom 20B of embodiment 20 and about 6" from the centerline. These slits are reinforced with double fabric 28A.

Once both arms are positioned through the slits 28, caregiver is ready to lift infant from the water. Having the arms go through arm slits protects sleeves from getting wet and creates a sling-like shape which provides safety when lifting infant from water with both hands and placing infant on main drying portion 20A. See FIG. 5.

With infant securely held with one hand to caregiver's chest, the lower part 20B of main drying portion 20A may be placed over baby's back. Then the hood 26 can be placed over the baby's head to dry and keep warm. See FIG. 6.

The free hand may also detach Velcro tabs 32A and 32B. The infant can now be placed over horizontal surface to dry and change or to swaddle baby FIGS. 7A, 7B, 7C and 7D. It is important to keep hood 26 over infant's head to prevent baby from getting cold.

Figure 7A:
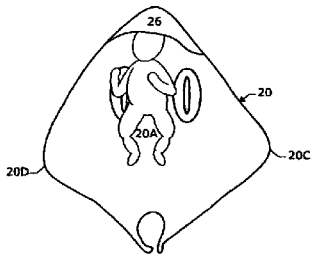
Figure 7B:
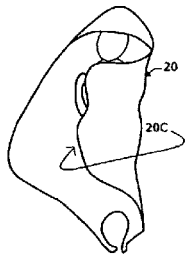
Figure 7C:
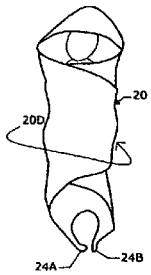

Once infant is dry and lying down over main drying portion 20A of embodiment 20 on top of a horizontal surface FIG. 7A, caregiver must place infant hands along his/her side and bring the right wing 20C across the infant's belly and arm and tuck it under the infant's opposite torso side FIG. 7B.

Then wrap left wing 20D across the infant's body and all the way around him/her until the caregiver runs out of fabric. It is important to pull the fabric snug but not tight FIG. 7C.

Figure 7D:
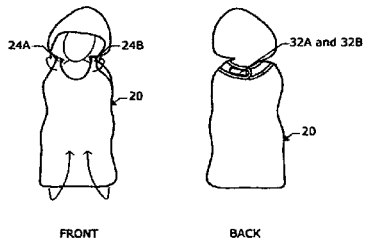

The final step is to bring neck end legs 24A and 24B up across the infant's body to fasten behind infant's neck FIG. 7D. The caregiver does this by compressing Velcro tabs 32A and 32B with light to moderate pressure to make a secure connection and form the enclosed collar FIG. 7D BACK. Velcro Tabs 32A and 32B should never be fastened in a different way than the way it is described here, wrong placement could result in injury.

Standing Toddler Case

Figure 5A:
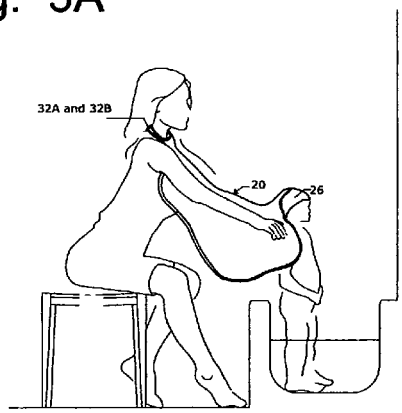
Figure 6A:
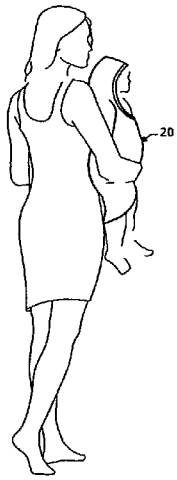
FIG. 6A shows caregiver carrying toddler wearing embodiment 20 as a hooded towel and taking the baby to the correspondent area to be dried, to arrange embodiment 20 as a bathrobe or to be changed.

To remove toddler from the water FIG. 5A, caregiver will place hood 26 over toddler's head, detach Velcro tabs 32A and 32B with one hand to release embodiment 20 from caregivers neck, while holding toddler with the other hand. Then wrap, embodiment 20 around toddlers body and lift toddler out of the water FIG. 6A to dry and change toddler or to follow the steps to arrange embodiment 20 as a bathrobe FIG. 8A, 8B, 8C and 8D.

Once toddler is dry and standing on a safe surface FIG. 8A, caregiver will help toddler put his/her arms through arm slits 28. Caregiver can then fold wing 20C over toddler's belly FIG. 8B and wing 20D to fasten Velcro tab 32C over 32D, as shown on FIG. 8C and then clasp snaps 30A,B,C and D as needed. As a final step caregiver will place neck leg 24B over 24A to attach Velcro tab 32B over 32A, FIG. 8D' and fold them upward between toddler legs to attach 34A under 32D.

The above detailed drawings and descriptions of the present drying garment illustrate its uniqueness, unobviousness, functionality and ease of use. As previously stated, it achieves its intended purposes through a new, useful, practical and safe combination of simple component elements and method of use to provide a complete solution to the bathing process of infants and toddlers. As opposed to many previous art inventions in the same field that are either unpractical and hard to use with too many difficult fastening devices, or cumbersome and bulky with excessive toweling.

The above drawings and descriptions are to be considered as illustrative and not restrictive in any way. Various modes of carrying out the present drying garment are contemplated as being within the scope of the following claims.

EXAMPLE—INFANT

It was that time of day again where I had to give my newborn a warm bath. But this time, it was going to be a different experience: for the first time, I picked up my new apron, towel baby wrap. I couldn't believe how light it was as I opened it!

I followed the instructions and wore it as an apron by putting the Velcro tabs together around my neck and then around my waist. It was so easy! I gave my baby a fun bath while I was wearing the towel and I felt so comfortable and happy since I knew that the towel I needed for my baby was around me.

Once I was ready to take my baby out of the bath, I opened the apron from around my waist with just one hand, while holding my baby (still in the tub) with the other hand. Then I carefully slid one arm at a time through the slits in the towel (while still holding my baby with the other arm) and carefully picked up my baby then put him directly on my chest and then easily wrapped the rest of the towel around him.

I was so happy to have my baby close to me, safe and warm. I stayed dry and was so pleasantly surprised to notice that the bathroom floor was dry too!

EXAMPLE—TODDLER

Bathing my two year old girl became a totally different experience once I started using my new apron, towel and bath wrap: I was so happy the first time I used it. I just followed the instructions and wore it as an apron by putting the Velcro tabs together around my neck and then around my waist. My daughter had so much fun splashing around in the water and for once, I didn't get upset because I stayed dry!

Once my daughter was ready to come out of the bath, I released the Velcro tabs from around my waist and put the hood on her head. Then, I was able to wrap the towel around her by releasing the Velcro closure from around my neck. I lifted her out of the bath and was able to dry her immediately since the towel was already around her. I then realized that I had forgotten to prepare her clothes. Instead of having to carry her across the hallway so that she doesn't drop the towel while walking, I simply put her arms through the slits and closed the rest of the towel around her legs with Velcro tabs, while she closed the snaps over her chest herself (she was so happy to do it on her own!) to form a safe bathrobe. We both loved it! She was happy to remain warm and walk around freely to play while I was able to prepare her clothes without worrying about her getting cold or dripping water everywhere.

I claim:

1. A drying garment for infants and toddlers to be worn by a caregiver as an apron to prevent getting wet during the bathing process, said garment comprising of an absorbent panel having:

a. a main drying portion, said main drying portion intended to cover said caregiver's chest,
b. a pair of converging legs forming a circular opening,
c. adjustable fastening means for attaching said converging legs to form a collar around the neck of said caregiver,
d. a hood opposite said converging legs,
e. two arm slits,
f. snaps to attach two sides of said garment,
g. a set of waist adjustable fastening means for attaching said garment around the waist of said caregiver,
h. a trim that finishes the perimeter of said drying garment.

2. The drying garment of claim 1, wherein said waist adjustable fastening means comprises a first and second pressure responsive connector and an optional adjustable elastic attachment, said attachment having an elastic, a fastener to adjust size of said elastic and fastening means to attach said adjustable elastic attachment to said garment, said fastening means are easily releasable by minimal outward pull that can be done with one of the said caregiver's hand.

3. The drying garment of claim 1, wherein said arm slits and said pair of converging legs are reinforced with double fabric, said fabric is a resilient, absorbent, and soft material.

4. The drying garment of claim 1 can be used to swaddle the said infant immediately after the bath.

5. The drying garment of claim 1 can be worn by said toddler as a bathrobe immediately after the bath.

6. A method of using a drying garment for a caregiver bathing an infant comprising the steps of:

a. said caregiver wears said drying garment as an apron with a hood facing forward to stay dry by attaching fasteners around the neck and around the waist,
b. said caregiver releases said garment from waist when ready to take said infant out of the water,
c. said caregiver puts said caregiver's arms one at a time through arm slits,
d. said caregiver takes infant out of the water with two arms and brings said infant on a main drying portion of said drying garment,
e. said caregiver places the hood on said infant's head,
f. said caregiver releases said fasteners around the neck and places said infant on a changing surface,
g. said caregiver folds remaining portions of said drying garment around said infant to provide a comfortable wrap to keep said infant warm by following said method.

7. A method of using a drying garment for a caregiver bathing a toddler comprising the steps of:

a. said caregiver wears said drying garment as an apron with a hood facing inward to stay dry by attaching fasteners around the neck and around the waist,
b. said caregiver releases said garment from waist when ready to take said toddler out of the water,
c. said caregiver places said hood on toddler's head,
d. said caregiver releases said fasteners around said caregiver's neck,
e. said caregiver lifts said toddler out of the water with two arms after wrapping a main drying portion of said drying garment around said toddler,
f. said caregiver dries said toddler and proceeds to folding said drying garment around said toddler as a bathrobe to keep said toddler warm by following said method.

* * * * *